United States Patent [19]

Reed, Jr.

[11] 4,092,383

[45] May 30, 1978

[54] MODIFICATION OF BALLISTIC PROPERTIES OF HMX BY SPRAY DRYING

[75] Inventor: Russell Reed, Jr., Ridgecrest, Calif.

[73] Assignee: The United States of America as represented by the Secretary of the Navy, Washington, D.C.

[21] Appl. No.: 824,372

[22] Filed: Aug. 15, 1977

[51] Int. Cl.[2] ..... C06B 21/00

[52] U.S. Cl. ..... 264/3 C; 149/19.4; 149/19.9; 149/92

[58] Field of Search ..... 149/19.4, 19.9, 92; 264/3 C

[56] References Cited

U.S. PATENT DOCUMENTS 4,043,850 8/1977 Hoffman et al. ..... 149/92 X

*Primary Examiner*—Stephen J. Lechert, Jr.

*Attorney, Agent, or Firm*—R. S. Sciascia; Roy Miller; Lloyd E. K. Pohl

[57] ABSTRACT

Cylotetramethylenetetranitramine (HMX) or cyclotrimethylenetrinitramine (RDX) and one or more additives are dissolved in a solvent and drops of the solution are dispersed into hot air whereupon the solvent evaporates and fine particles of the explosive with the additive(s) intimately associated are formed. Reactive groups from the additives may then be utilized to facilitate wetting of the explosive by a binder or to chemically attach the explosive to the binder.

12 Claims, No Drawings

MODIFICATION OF BALLISTIC PROPERTIES OF HMX BY SPRAY DRYING

BACKGROUND OF THE INVENTION

1. Field of the Invention.

This invention relates to a method for treating HMX or RDX to render it wettable by or chemically attachable to a binder.

2. Description of the Prior Art.

The technique of "spray drying" is well known. For example, it is commonly used in the weather modification field. In that field, drops of solutions of weather modification material are sprayed into the air whereupon the solvent evaporates and fine crystals of the weather modification material form to float down through the air and provide condensation nuclei. Spray drying is also used commercially to produce some well known food commodities. And spray drying has been used to form very fine particles of HMX.

To form fine particles of HMX, the HMX is simply dissolved in a suitable solvent and droplets of the solution are sprayed into warm air whereupon the solvent evaporates and the fine particles are formed much in the same manner as indicated above in connection with weather modification.

One reason for making fine particles of HMX is to provide for good mechanical properties. The fineness contributes to the "toughness" of a propellant made from the explosive. However, even very fine particles of HMX are difficult to wet. That is, the binder in plastic bonded explosives and propellants that contain HMX often pulls away from the HMX leaving voids and cracks that are well known to be undesireable. The same is, of course, true of RDX.

SUMMARY OF THE INVENTION

The term "explosive" used herein means HMX, RDX or a mixture thereof.

According to this invention, explosive is rendered more wettable by a spray drying process in which the following steps are carried out. First, the explosive and an additive which contains groups that will facilitate wetting by a plastic bonded explosive binder or the like are dissolved in a material that is a solvent for both the explosive and the additive. Then the solution is dispersed into hot air, the temperature of the air being such that it will cause the solvent to evaporate. When the solvent evaporates, fine spherical crystals of explosive form. Intimately associated with these crystals are additive molecules. Later, when the explosive is incorporated into a plastic bonded explosive, propellant or the like, the reactive groups from the intimately associated additive molecules which are compatible with the binder facilitate wetting by the binder. The reactive groups of the additive may be chosen so that they actually react with binder reactive groups to chemically attach the explosive to the binder. In fact, the latter is preferable.

DESCRIPTION OF THE PREFERRED EMBODIMENTS

In practicing this invention, it is often convenient to utilize an additive that contains primary hydroxyl groups. The reason for this is that many binders used in plastic bonded explosives, propellants and the like are isocyanate cured to yield polyurethane polymers. Primary hydroxyl groups readily react with isocyanate groups and thus the solid explosive-additive particles will chemically link the explosive to such a binder. However, it should be realized that additives containing reactive groups other than hydroxyl may be used. That is, the reactive groups of the additive are chosen either so that they will react with reactive groups of the binder to be used or simply to render particles containing them wettable by the binder; hydroxy groups are not necessary simply to make the particles wettable.

A hydroxyl containing additive may be either monomeric or polymeric. Examples of monomeric additives that contain primary hydroxyl groups and have been found suitable for chemically attaching particles to binders that contain isocyanate groups are:

1. The solid primary alcohols having the formula R—CH OH wherein R is alkyl, alkenyl, alkynyl, aryl, cycloaliphatic or a combination thereof;
2. Solid compounds having the formula $R—CH(CH_2OH)_2$ wherein R is the same as set forth in 1 above;
3. Solid compounds having the formula $R—C(CH_2OH)_2$ wherein R is the same as set forth in 1 above;
4. Acrylates having the formula

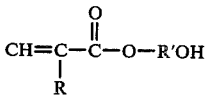

wherein R is hydrogen or a member of the group set forth in 1 above and wherein R′ is $(CH_2)_x$ and $_x$ is a positive intiger;

5. Hydroxyl diacrylates having the formula $HOR'CH(OOCCR{=}CH_2)CH_2(OOCCR{=}CH_2)$ wherein R is hydrogen or a member of the R group set forth in 1 above and R′ is the same as set forth in 4 above; and
6. Metallocenes which have primary hydroxy groups attached such as $Fc—CH_2OH$ wherein Fc is the ferrocenyl group.

As pointed out above, polymeric materials may also be used. In some cases, the process may begin with a monomeric material and the material may polymerize in situ as the solvent evaporates and it becomes intimately associated with the explosive. This may be made to occur when, for example, an acrylate is used as the starting additive.

Propylene glycol monoacrylate which contains secondary rather than primary hyroxyl may also be used as an additive. It has the formula $CH_2{=}CH—COOCH_2CH(CH_3)OH$. Its reaction with isocyanate is somewhat slower than that of primary hydroxyls but reaction does take place.

The additives listed above are not the only additives suitable. Any chemical that will adhere to the explosive and facilitate wetting or react with a binder is suitable.

After selecting the additive, the next step in practicing this invention is to select a solvent that will dissolve both the additive and explosive. As examples of suitable solvents that will dissolve HMX, RDX and the additives named above one may list dimethyl sulfoxide, acetone, pyrrolidone and dimethyl acetamide. These solvents may be used either alone or in combination. The foregoing list is, of course, not exhaustive. Any solvent which will dissolve both the explosive and the chosen additive is suitable so long as it doesn't interfere with subsequent events.

Once the solvent and additive have been chosen, the next step is to dissolve the additive and explosive in the solvent. Procedures for dissolving materials in other materials are, of course, well known and need not be detailed here.

After the solution has been prepared, the next step is to disperse drops of it into warm air. When hydroxyl containing additives of the types set forth above are used, the air should be heated to a temperature in the range of from about 125° F to about 250° F. Dispersion may be accomplished by any well known technique such as by spraying or by allowing the solution to fall onto a spinning wheel which throws small droplets of it into the air.

Upon being dispersed into the warmed air, the solvent evaporates and crystals of explosive form. Intimately associated with the explosive crystals are molecules of the additive. The additive is attracted to the crystals by short range polar forces. In cases where the additive polymerizes in situ, polymeric chains may entrap crystallites of explosive within a polymeric matrix.

Of course, after the crystals with their intimately associated additive molecules are formed, they are collected and processed with a binder to form plastic bonded explosives or propellants. If, for example, the additive molecules contain hydroxyl groups and the binder contains isocyanate groups, the hydroxyl groups will readily react with the isocyanate groups to chemically attach the explosive to the binder.

As pointed out above, it may be desirable simply to choose an additive because it is compatible with, i.e., wettable by, the binder. One example of such an additive might be a block copolymer chosen so that certain blocks are compatible with or attracted to the explosive and so that other blocks are compatible with or attracted to the binder. In other words, an actual chemical reaction between additive groups and binder groups is not necessary. On the other hand, the preferred or best mode of practicing the invention contemplates the use of additives which do react with the binder.

Insofar as the relative amounts of explosive and additive are concerned, a wide range is permissible. If the additive contains a large number of groups that are reactive with the binder (for example a triol) the amount of additive utilized with respect to the amount of explosive used may be low. On the other hand, if the additive contains only one reactive group per molecule the amount of additive used should be somewhat higher.

If a polymer is to be formed in situ, a free radical initiator such as an organic peroxide may be added to the solution of the explosive and additive to catalyze the reaction.

By practicing this invention, the mechanical properties of a final plastic bonded explosive or propellant are greatly improved because the explosive (HMX or RDX) crystals are either better wet by the binder or chemically attached to it. This, of course, renders the plastic bonded explosive or propellant much safer than those in which the HMX or RDX is not treated in the mannner described above. In other words, the practice of this invention enables one to avoid the voiding or cracking spoken of above in the description of the prior art.

What is claimed is:

1. A method for rendering an explosive selected from the group consisting of cyclotetramethylenetetranitramine, cyclotrimethylenetrinitramine and mixtures thereof wettable by a binder comprising the steps of:

A. selecting an additive which is compatible with said binder;

B. dissolving said additive and explosive in a common solvent to form a solution; and C. dispersing drops of said solution into warm air whereupon the solvent evaporates and crystals of the explosive having molecules of said additive closely associated therewith are formed.

2. A method according to claim 1 wherein said additive is a material containing primary hydroxyl groups.

3. A method according to claim 1 wherein said additive is a material containing secondary hydroxyl groups.

4. A method according to claim 2 wherein said additive is selected from the group consisting of solid primary alcohols having the formula R—CHOH wherein R is selected from the group consisting of alkyl, alkenyl, alkynyl, aryl, cycloaliphatic and combinations thereof.

5. A method according to claim 2 wherein said additive is selected from the group consisting of solid compounds having the formula $R—CH(CH_2OH)_2$ wherein R is selected from the group consisting of alkyl, alkenyl, alkynyl, aryl, cycloaliphatic and combinations thereof.

6. A method according to claim 2 wherein said additive is selected from the group consisting of solid compounds having the formula $R—C(CH_2OH)_3$ wherein R is selected from the group consisting of alkyl, alkenyl, alkynyl, aryl, cycloaliphatic and combinations thereof.

7. A method according to claim 2 wherein said additive is an acrylate having the formula

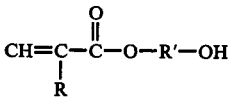

wherein R is selected from the group consisting of H, alkyl, alkenyl, alkynyl, aryl, cycloaliphatic and combinations thereof and wherein R′ is selected from the group consisting of $(CH_2)_X$ wherein X is a positive intiger.

8. A method according to claim 2 wherein said additive is selected from the group consisting of hydroxyl diacrylates having the formula $HOR'CH(OOCCR{=}CH_2)CH_2(OOCCR{=}CH_2)$ wherein R is selected from the group consisting of H, alkyl, alkenyl, alkynyl, aryl, cycloaliphatic and combinations thereof and wherein R′ is selected from the group consisting of $(CH_2)_X$ wherein X is a positive intiger.

9. A method according to claim 2 wherein said additive is selected from the group consisting of metallocenes having primary hydroxy groups attached.

10. A method according to claim 9 wherein said metallocene has the formula $Fc—CH_2OH$ wherein Fc is a ferrocenyl group.

11. A method according to claim 3 wherein said additive is propylene glycol monoacrylate.

12. A method according to claim 1 wherein said common solvent is selected from the group consisting of dimethyl sulfoxide, acetone, pyrrolidone, dimethyl acetamide and combinations thereof.

* * * * *